US005781183A

United States Patent [19]

Takahashi et al.

[11] Patent Number: 5,781,183

[45] Date of Patent: Jul. 14, 1998

[54] IMAGE PROCESSING APPARATUS INCLUDING SELECTING FUNCTION FOR DISPLAYED COLORS

[75] Inventors: Mitsuhiro Takahashi; Syouichi Tahata, both of Hokkaido, Japan

[73] Assignee: Hudson Soft Co., Ltd., Hokkaido, Japan

[21] Appl. No.: 857,717

[22] Filed: May 16, 1997

Related U.S. Application Data

[60] Continuation of Ser. No. 450,187, May 25, 1995, abandoned, which is a division of Ser. No. 112,089, Aug. 26, 1993, abandoned.

[30] Foreign Application Priority Data

Oct. 1, 1992 [JP] Japan ..... 4-284977
Oct. 14, 1992 [JP] Japan ..... 4-300670

[51] Int. Cl.[6] ..... G09G 5/06

[52] U.S. Cl. ..... 345/199; 345/186

[58] Field of Search ..... 345/186, 187, 345/188, 199, 200, 119, 153, 154, 155, 150; 348/564, 585

[56] References Cited

U.S. PATENT DOCUMENTS 4,608,596 8/1986 Williams et al. .
4,689,669 8/1987 Hoshino et al. .
4,868,552 9/1989 Chang ..... 345/115
4,954,970 9/1990 Walker et al. ..... 345/153
5,128,658 7/1992 Pappas et al. ..... 345/119
5,130,701 7/1992 White et al. .
5,175,624 12/1992 Hieda et al. ..... 348/564
5,204,665 4/1993 Bollman et al. .
5,227,863 7/1993 Bilbrey et al. ..... 348/585
5,233,684 8/1993 Ulichney .
5,253,078 10/1993 Balkanski et al. .
5,282,026 1/1994 Nagata .
5,371,512 12/1994 Otake et al. ..... 345/114

FOREIGN PATENT DOCUMENTS 0134640 5/1993 Japan ..... 345/199

*Primary Examiner*—Chanh Nguyen
*Attorney, Agent, or Firm*—Lowe, Price, LeBlanc & Becker

[57] ABSTRACT

Colors of plural pictures are defined by using color pallet data. Predetermined digital data are stored in a memory. The color pallet data are converted to the corresponding digital data stored in the memory. The memory contents are addressed by using an offset address (relative address) established for each picture.

2 Claims, 20 Drawing Sheets

FIG. 8

| COLOR PALLET ADDRESS | D15 | D14 | D13 | D12 | D11 | D10 | D9 | D8 | D7 | D6 | D5 | D4 | D3 | D2 | D1 | D0 |
|---|---|---|---|---|---|---|---|---|---|---|---|---|---|---|---|---|
| 0 | Y DATA | | | | | | | | U DATA | | | | V DATA | | | |
| 1 | Y DATA | | | | | | | | U DATA | | | | V DATA | | | |
| 2 | Y DATA | | | | | | | | U DATA | | | | V DATA | | | |
| 3 | Y DATA | | | | | | | | U DATA | | | | V DATA | | | |
| ⋮ | | | | | | | | | | | | | | | | |
| 100 | Y DATA | | | | | | | | U DATA | | | | V DATA | | | |
| 101 | Y DATA | | | | | | | | U DATA | | | | V DATA | | | |
| ⋮ | | | | | | | | | | | | | | | | |
| 509 | Y DATA | | | | | | | | U DATA | | | | V DATA | | | |
| 510 | Y DATA | | | | | | | | U DATA | | | | V DATA | | | |
| 511 | Y DATA | | | | | | | | U DATA | | | | V DATA | | | |

FIG. 9

| | | | | | | | | | |
|---|---|---|---|---|---|---|---|---|---|
| COLOR PALLET DATA | D7 | D6 | D5 | D4 | D3 | D2 | D1 | D0 | |
| + | | | | | | | | | |
| COLOR PALLET ADDRESS OFFSET × 2 | D7 | D6 | D5 | D4 | D3 | D2 | D1 | D0 | 0 |
| = | | | | | | | | | |
| COLOR PALLET ADDRESS | D8 | D7 | D6 | D5 | D4 | D3 | D2 | D1 | D0 |

FIG. 10

| PICTURE | | COLOR PALLET DATA | | | | | | | |
|---|---|---|---|---|---|---|---|---|---|
| | | D7 | D6 | D5 | D4 | D3 | D2 | D1 | D0 |
| VDP | SPRITE | PALLET BANK No. | | | | PALLET No. | | | |
| | BG | PALLET BANK No. | | | | PALLET No. | | | |
| CONTROL UNIT | 4 COLOR MODE | 0 | 0 | PALLET BANK No. | | | | PALLET No. | |
| | 16 COLOR MODE | PALLET BANK No. | | | | PALLET BANK No. | | | |
| | 256 COLOR MODE | PALLET No. | | | | | | | |
| IMAGE DATA EXTENSION UNIT (RL SCREEN) | 16 COLOR MODE | 0 | 0 | 0 | 0 | PALLET No. | | | |
| | 32 COLOR MODE | 0 | 0 | 0 | PALLET No. | | | | |
| | 64 COLOR MODE | 0 | 0 | PALLET No. | | | | | |
| | 128 COLOR MODE | 0 | PALLET No. | | | | | | |

FIG. 11

FIG. 12

FIG. 13

64K COLOR MODE

16M COLOR MODE

IMAGE PROCESSING APPARATUS INCLUDING SELECTING FUNCTION FOR DISPLAYED COLORS

This application is a continuation of application Ser. No. 08/450,187 filed May 25, 1995 now abandoned, which is a division of application Ser. No. 08/112,089 filed Aug. 26, 1993 now abandoned.

BACKGROUND OF THE INVENTION

The present invention relates to an image processing apparatus synthesizing a plurality of pictures, and more particularly to a computer graphic apparatus processing a variety of images, such as animation, natural pictures and the like.

In a conventional game computer, an image processing function is mainly realized by an external memory, a CPU (central processing unit), a VRAM (video RAM), a VDC (video display controller), a VDE (video encoder) and a CRT. In this type of computer, image data are transmitted from the external memory to the VRAM, and are read from the VRAM by the CPU. The VDC generates background image data in accordance with the data stored in the VRAM, and the background image data are supplied to the VDE. The background image is formed in accordance with a character pattern defined by a raster of the CRT and character pitch.

The background image is managed by using a background attribute table (BAT) and a character generator (CG) in the memory (RAM), as shown in FIG. 1. The BAT is composed of a CG color of 4 bits and a character code of 12 bits, to specify positions and colors of the characters to be displayed. The CG is incorporated in the RAM for storing four actual character patterns corresponding to CG codes in the BAT. Each character pattern is defined by 8×8 dots and 16 colors.

In such a computer, first, an address of the raster position to be displayed is generated, then the character code and CG color are given in accordance with the address. An address of the CG is produced in accordance with the character code. The pattern data stored in the CG are read out in accordance with the CG address, and are transmitted with the CG color code to the following stage.

In the VDC, the CG color code and pattern data supplied from the VDC are converted to the RGB signal by a D/A converter in accordance with the contents of a color pallet RAM. The color pallet RAM stores RGB digital data written by the CPU. The CPU generally reads data from the external memory in the order of address, and writes the data in the color pallet RAM by a continuous increment process.

FIG. 2 shows the structure of the color pallet RAM. The color pallet RAM has color pallets of "256 addresses×9 bits", and is divided into 16 blocks of "16 addresses×9 bits". The RGB data are stored in the 9 bit area. That is, each color of the RGB has 3 bits, and one dot is defined by one address. Each block has 16 colors selected from 256 colors.

In most game computers which treat many images such as animations, background (BG) and sprite (SP) images are superimposed to perform an active display. The background and sprite images are composed of character patterns and sprite patterns, respectively. For example, each character and sprite are indicated by "8×8" dots and "16×16" dots, respectively.

A position of each character is defined by a raster and a character pitch on the real screen (CRT). That is, the background image may be defined by the positions, colors and patterns of the characters. The positions of the characters to be displayed are indicated on the coordinates of the CRT. Character information at the raster scanning position is converted to an image signal to display the information on the CRT.

FIG. 3 corresponds to FIG. 1. The CG is composed of a plurality of background pictures. For example, 2 and 4 pictures are superimposed in 4 and 16 color modes, respectively.

The color of each character block is defined dot by dot, and the color of each dot is defined by total bits of all the corresponding dots on each character elements CH0 to CH3, as shown in FIG. 4. Specifically, when the corresponding dots of character elements CH0 to CH3 are indicated by b0, b1, b2 and b3, a color "C" of the dot to be represented is given by an equation "$C=b0\times2^0+b1\times2^1+b2\times2_2+b3\times2^3$". It can be considered that the color "C" may be treated as a color code directly. However, the conventional game computer uses a color pallet which stores plural color codes to manage colors of the background image so that many colors may be used for displaying one background image. The color pallet is specified in position by the color codes of the CG.

The character code in the BAT indicates the address in the CG. A color to be displayed is selected from the color pallet in accordance with both the CG COLOR and color code. That is, first, a color block is selected from the CG in accordance with the CG COLOR, then a color is selected from the color block in accordance with the color code, as shown in FIG. 5. The CG COLOR is defined by 4 bit data, so that sixteen color blocks may be represented. Each color code is defined by 4 bit data, whereby sixteen colors may be used for each character. Ultimately, sixteen colors are selected from 256 (16×16) colors.

According to the conventional image processor shown in FIGS. 1 and 2, one background picture only is treated, so that a variety of color data may be generated by using the single color pallet, which is specified by an absolute address produced in accordance with the CG color code and pattern data.

Recently, it is required that a variety of image data be treated in order to realize a multi-media process in a computer. Therefore, many kinds of image data in which a color code is generated by using the color pallet need to be processed in the image processor. In this situation, when each picture has its own color pallet RAM, the CPU must perform much processing. If a single color pallet RAM is used for specifying color data for plural pictures, it is necessary to change the color data for each picture, because the color data are written by the continuous increment process. It is complicated to give an absolute address for rewriting in accordance with a start address and the arrangement of the color data, because the address and color data do not correspond each other.

According to the conventional image processor shown in FIGS. 3 to 5, each color is defined by 8 bits for each dot, that is, 256 ($=2^8$) colors must totally be used for each picture. However, a natural picture can not be displayed by using 256 colors only. If 64K or 16M ($=2^{24}$) colors are used in the system, the color pallet RAM needs to have a huge capacity. For example, in the 16M color mode, 24 bits must be used to display one color, so that a capacity of 16M (16×1,048,576) bits must be taken in the color pallet RAM. That is, a 2M bytes memory region is necessary to be used for the color pallet RAM.

SUMMARY OF THE INVENTION

It is an object of the present invention to provide a high performance computer in which a variety of images may be processed by using a single color pallet RAM.

According to the invention, an image processing apparatus, in which colors of plural pictures are defined by using color pallet data, includes a memory which stores digital data for defining the colors of the pictures, and converts the color pallet data to corresponding digital data. The memory is addressed by using an offset address (relative address) established for each picture.

In more detail, the memory (color pallet RAM) is addressed by using offset type address data (relative address data) so that a pallet base address of the color pallet RAM may be changed. In the invention, a start address for rewriting is specified as the offset address. When each of the pictures to be displayed has its own offset address, different colors may be specified for the pictures by using the same pallet data. The address and color data definitely correspond to each other, so that many colors may be used to display the image easily. For example, the color pallet address of 9 bits is defined by the color pallet data of 8 bits and offset address of 8 bits. The offset address does not specify the color pallet directly, that is, a half of the offset address is set in a special register. Namely, the color pallet address is given by the following formula.

COLOR PALLET ADDRESS=COLOR PALLET DATA+OFFSET ADDRESS×2

In the invention, YUV system data are used instead of RGB system data to define a display color. The display colors are specified by using the color pallet in a video encoder when the number of the colors is less than a predetermined number (for example, 256), and the colors are specified by the YUV color data directly when the number of the colors is more than the predetermined number.

When the RGB system data are adopted, a color to be displayed is defined by the three colors red, green and blue. When the YUV system data are adopted, a color to be displayed is defined by brightness data (Y) and color difference data (U and V), in which "Y" indicates brightness, "U" indicates a color difference in a blue-yellow family, and "V" indicates a color difference in a red-green family. The "Y" data have hexadecimal data "00" (black) to "FF" (white), and each of the "U" and "V" data has "0" to "15" in which "8" indicates no color.

BRIEF DESCRIPTION OF THE DRAWINGS

FIG. 8 is a diagram showing the configuration of a color pallet RAM in accordance with the preferred embodiment.

FIG. 9 is a diagram showing a color pallet address in accordance with the preferred embodiment.

FIG. 10 is a table showing color pallet data in accordance with the preferred embodiment.

FIGS. 11 to 21 are diagrams showing the configurations of an address register, status register, control register, color pallet address register, color pallet data write register, color pallet address offset register 1, color pallet address offset register 2, color pallet address offset register 3, color pallet address offset register 4 and two priority registers, respectively, in accordance with the preferred embodiment.

DETAILED DESCRIPTION OF THE INVENTION

Hereinafter, an image processing apparatus of a preferred embodiment according to the present invention will be explained in conjunction with appended drawings.

Figure 6:
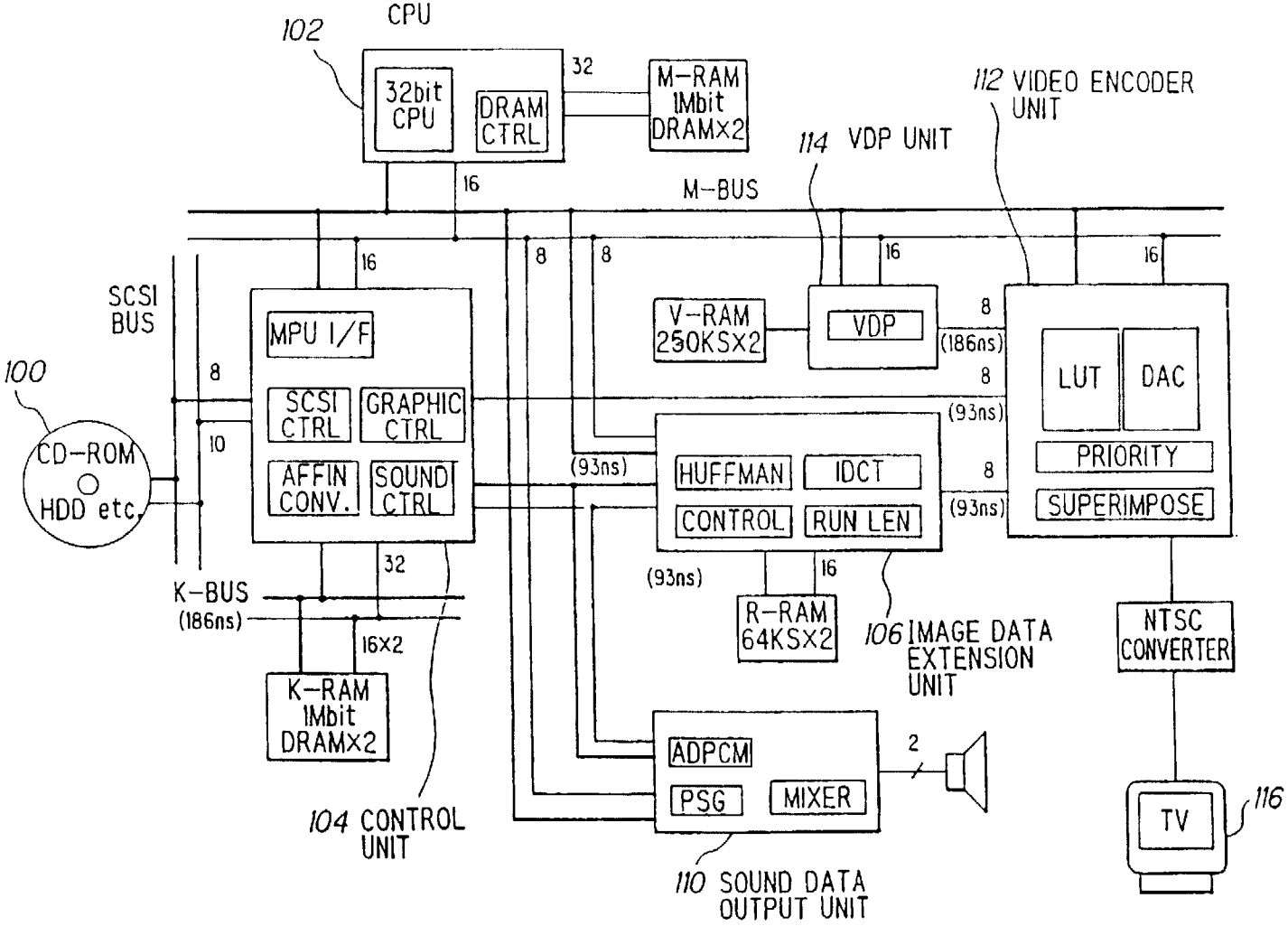
FIG. 6 is a block diagram showing a computer system according to a preferred embodiment.

FIG. 6 shows a computer system of the preferred embodiment. The system includes a game-software recording medium 100 such as a CD-ROM, a CPU 102 of 32-bit type, a control unit 104 for mainly controlling transmission of image and sound data and interfacing most devices to each other, an image data extension unit 106, an image data output unit 108, a sound data output unit 110, a video encoder unit 112, a VDP unit 114 and a TV display 116. CPU 102, control unit 104, image data extension unit 106 and VDP unit 114 are provided with their own memories K-RAM, M-RAM, R-RAM and V-RAM, respectively.

CPU 102 directly controls a DRAM via a memory support, and perform communication through an I/O port to peripheral devices, that is, an I/O control function. CPU 102 includes a timer, a parallel I/O port and a interruption control system. VDP unit 114 reads display data which have been stored in the VRAM by CPU 102. The display data are transmitted to video encoder unit 112 whereby the data are displayed on the TV display 116. VDP unit 114 has at most two screens each composed of background and sprite images, which are of an external block sequence type data (8×8 blocks).

Control unit 104 includes an SCSI controller to which image and sound data are supplied from CD-ROM 100 through an SCSI interface. Data supplied to the SCSI controller is buffered in the K-RAM. Control unit 104 also includes a DRAM controller for reading data which have been buffered in the K-RAM, at a predetermined timing. In control unit 104, priority judgement is carried out for each dot of natural background image data, and an output signal is transmitted to video encoder unit 112.

Control unit 104 transmits moving image data (full color, pallet), which has been reduced, to image data extension unit 106 whereby the scale-down data are extended. The extended data are transmitted from image data extension unit 106 to video encoder unit 112.

Video encoder unit 112 superimposes VDP image data, natural background image data and moving image data (full color, pallet) transmitted from VDP unit 114, control unit 104 and image data extension unit 108, respectively. Video encoder unit 112 performs color pallet reproducing, special effect processing, D/A converting and the like. Output data of video encoder unit 112 are encoded into an NTSC signal by an external circuit.

ADPCM sound data which have been recorded in CD-ROM 100 are buffered in the K-RAM and then transmitted to sound data output unit 110 by control unit 104. The sound data are reproduced by sound data output unit 110.

Figure 7:
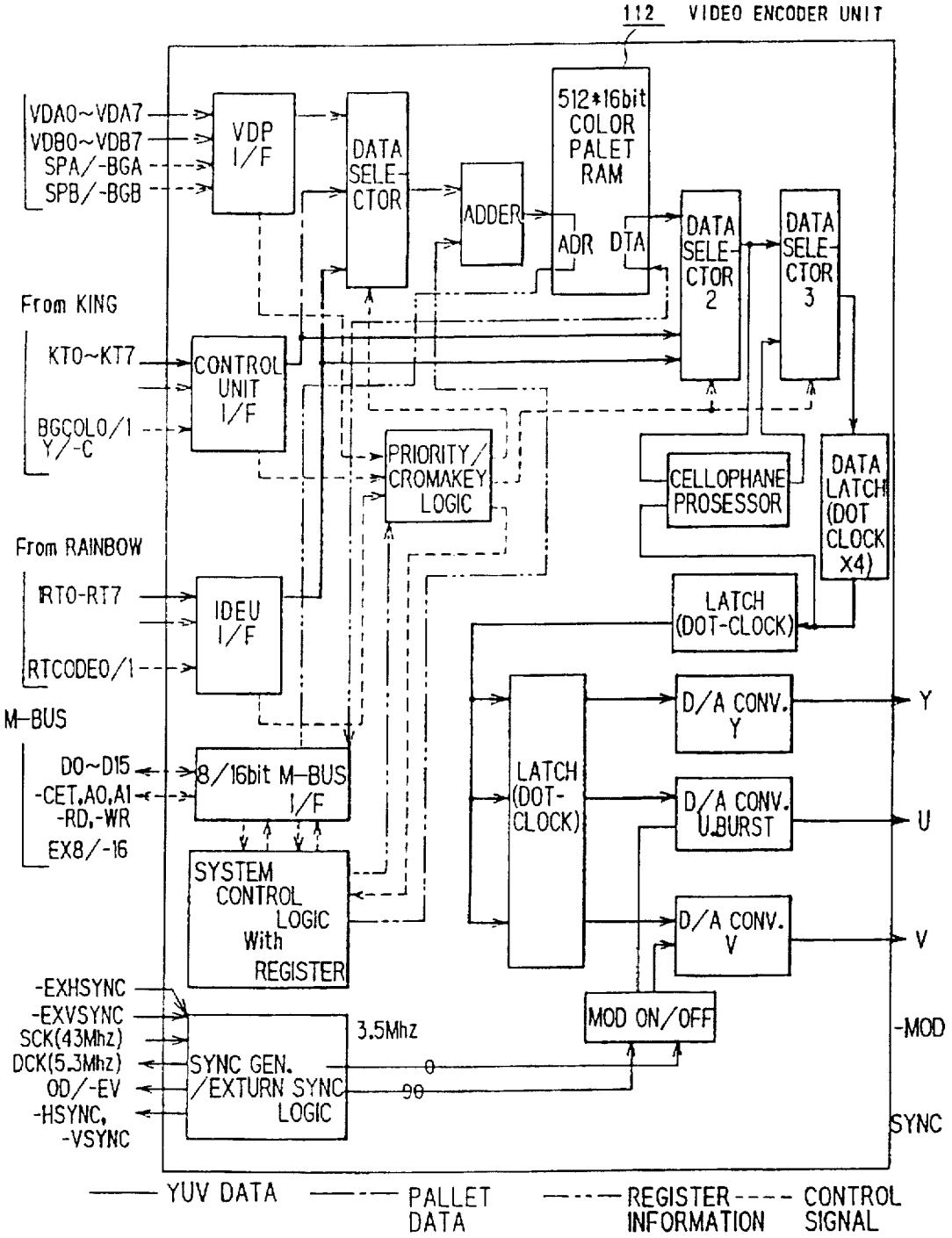
FIG. 7 is a block diagram showing a video encoder unit in the computer system shown in FIG. 6.

FIG. 7 shows the video encoder unit. The video encoder unit is composed of an IC including a synchronizing signal generating circuit, a color pallet RAM, a priority arithmetic circuit, a cellophane arithmetic circuit (for synthesizing upper and lower pictures), a D/A converter for an image signal, an 8/16 bit data bus (M-bus) interface, a VDP interface, a control unit interface and an image data extension unit interface.

The 8/16 bit data bus interface is an I/F switching circuit which selects one from 8 and 16 bit data buses to be used for data processing at the video encoder unit side. The selection is carried out in accordance with data width of the data bus of the processing system including the CPU.

The VDP interface receives data transmitted from two of upper and lower VDPs. Normally, the VDP interface receives data from the upper VDP. The VDP interface receives data from the lower VDP only when the upper VDP supplies chromakey data.

The color pallet RAM transforms a video input signal into a YUV digital signal.

The video encoder unit has registers (16 bits×24 lines), which are accessed by the CPU to set an operation mode therein, and to specify read and write modes for the color pallet.

The color pallet RAM transforms color pallet data into YUV data to be actually displayed, as mentioned before. As shown in FIG. 8, the color pallet RAM includes a color information table divided into 512 address regions each having one color and 16 bit data regions. Each color data are composed of 8 bits "Y", 4 bits "U" and 4 bits "V", so that 65536 colors may be available. The "Y" data indicate brightness in a range 00 (black) to FF (white), the "U" data indicate color difference for a blue-to-yellow family in a range 0 to 15, and the "V" data indicate color difference for a red-to-green family in a range 0 to 15. Each of the U and Y data are set at a value 8 when no-color is represented. After the reset process, YY=00h, U=0h and V=h are automatically set at the "0" of the color pallet address. For that reason, color data need to be set at the address 0 again after the reset process.

How to set the YUV data at the color pallet RAM is now explained. The contents of the color pallet RAM are formed by the CPU, and are read in accordance with color pallet information from the VDP, control unit and image data extension unit. The read data are transformed into the Y, U and V data. The CPU can read the contents of the color pallet RAM.

The data are written in the color pallet RAM continuously in accordance with the following steps. 1st step: Setting a register number "01h" of a color pallet address register (CPA) in an address register (AR). 2nd step: Writing a start address in the color pallet address register (CPA). 3rd step: Writing a register number of a color pallet data write register (CPW) in the address register (AR). 4th step: Writing data in the color pallet data write register to increment the CPA. 5th step: Writing data in the color pallet data write register again to increment the CPA.

In the 8 bit bus mode, data are written in the data write register in the order of lower to upper bytes. After the upper bytes data are written in the data write register, the data are written in an internal register, and the CPA is incremented.

The data are read from the color pallet RAM continuously in accordance with the following steps. 1st step: Setting a register number "01h" of the color pallet address register (CPA) in the address register (AR). 2nd step: Writing a start address in the color pallet address register (CPA). 3rd step: Setting a register number 03h of the color pallet data read register (CPR) in the address register (AR). 4th step: Reading data from the color pallet data read register to increment the CPA. 5th step: Reading data from the color pallet data read register to increment the CPA.

In the 8 bit bus mode, data are read from the data read register in the order of the lower to upper bytes. After the upper bytes data are read from the data read register, the data are written in the internal register so that the CPA is incremented.

Next, how to display the color pallet data will be explained. The color pallet data stored in the VDP, control unit and image data extension unit are transformed to the YUV data in accordance with the contents of the color pallet RAM to form an actual image. All screens using the color pallet data are treated by the common color pallet RAM because only one color pallet RAM is provided. If a color pallet address offset register is used, color pallet start addresses may be specified for each picture separately.

In a priority process block, a picture to be displayed is specified dot-by-dot. If the specified picture is a color pallet data picture, a color pallet address offset value of the picture is read from the register. After that, double the offset value is added to the color pallet data to provide a color pallet address. In accordance with the color pallet address, the color data Y, U and V are generated for each dot, and are transmitted to the following stage. The color pallet address is given by calculating the color pallet data and the color pallet offset value specified for each picture, the formula for the calculation being shown as follows and in FIG. 9.

COLOR PALLET ADDRESS (9 bits)=COLOR PALLET DATA (8 bits) +(COLOR PALLET ADDRESS OFFSET VALUE)×2

Even though the same color pallet data are used for the different pictures, different colors may be generated for the pictures.

The VDP has only one color pallet offset register, so that if plural VDPs are used, the plural VDPs have to use the single register in common. If the color pallet address is over 511, the tenth bit is omitted, that is, the ninth bit is connected to 0 address, as shown in FIG. 9. When the CPU accesses the color pallet RAM directly, the color pallet address offset is not effective.

FIG. 10 shows the contents of color pallet data transmitted from each of the LSIs. In a calculation of a color pallet address, a pallet bank number is treated as the first bits of a pallet number, that is, the pallet and pallet bank numbers are not distinguished from each other. Therefore, all 8 bits data in each mode are treated as the color pallet data.

In this preferred embodiment, the VDP unit treats two kinds images of the sprite (SP) and background (BG), the control unit treats four images BMG0, BMG1, BMG2 and BMG3, and the image data extension unit treats an IDCT/RL image, respectively. The video encoder unit may be connected with the upper and lower VDPs. If both the upper and lower VDPs are connected to the video encoder, one of the VDPs is selected to be connected at an input interface portion. The upper VDP is generally selected and the lower VDP is selected only when the upper VDP supplies chromakey data.

The priority order of the SP and BG images of the VDP and the pictures BMG0 to BMG3 can not be changed only by the priority register of the video encoder unit. Therefore, if the priority order is changed, all the units must be changed.

The priority order is decided for each dot for each LSI by the video encoder unit in accordance with image information, the value of the priority register and the like, the image information being transmitted from the VDP, control unit and image data extension unit.

The video encoder unit contains a synchronizing signal generating circuit, so that a dot clock, horizontal synchronizing signals —HSYNCA, —HSYNCB and —HSYNCC and a vertical synchronizing signal -VSYNC are supplied to peripheral devices when a chrominance subcarrier frequency of 12 colors is supplied to the encoder unit. The synchronizing signal generating circuit has an external synchronizing function, that is, an image can be displayed in synchronization with an external image.

In the D/A converter of the video encoder, a YUV signal of 8 bits is converted into an analog signal. If a UV signal contains only 4 bits like pallet data, "0000" data are added to the last figure of the UV signal to make it 8 bit data. The Y data are converted into an analog signal in linear fashion, for example, "00h" data are converted to a black color signal and "FFh" data are converted to a white color signal.

The U and V data are also converted to analog signals in linear fashion. In the analog signals, over and under "80h" data are expressed as positive and negative, respectively, because the U and V data have polarities.

The color depth varies in series with the difference value from "80h". When the data is "00h" or "FFh", the color becomes the deepest. When both the U and V are "80h", no color is expressed. The color hue is defined by the ratio between the difference values of the U and V signals from "80h", and the polarities thereof.

In the D/A conversion process, it may be selected whether the Y signal is treated with a synchronizing signal, and whether the U and V signals are modulated by chrominance subcarrier. If the chrominance subcarrier modulation is selected, color burst is superimposed on the U signal at a predetermined timing and amplitude. The D/A converter is of a current adding type, that is, a voltage conversion is carried out in accordance with the input impedance of external circuits.

In an external circuit, when predetermined analog arithmetic operations are performed using the Y signal with no synchronizing signal and the non-modulated UV signal, an RGB signal is generated. When the Y signal with synchronizing signal and the modulated UV signal are mixed by an external circuit, a composite video signal for the CRT display monitor is generated.

FIGS. 11 to 13 show the arrangements of an address register, the status register and a control register in the video encoder unit, respectively. The status and control registers are indirectly accessed through the address register.

The address register (AR) specifies internal registers R00 to R15 in the video encoder unit. The status register holds the current information of the displayed image.

In the status register;

(a) An "AR" at the 0th to 4th bits indicates the current value of the address register.

(b) A "RASTERCOUNT" at the 5th to 13rd bits indicates a raster number of the current display in the display period of 22 to 261. The raster number set at the "RASTERCOUNT" does not correspond to a scanning line number defined by the NTSC signal. The raster number becomes "1FFh" when an external synchronizing signal is disturbed.

(c) An "O/E" at the 14th bit indicates whether an image is displayed at odd fields (1) or even fields (0) in the interlace mode.

(d) A "DISP" at the 15th bit indicates whether the video encoder is working in a display period (H blank, V blank). "0" and "1" are set at the 15th bit in the display period and non-display period, respectively.

In the control register (CR : R00), the 8th to 14th bits and the others are available from the following horizontal and vertical periods, respectively.

(a) A "DCC" at the 0th and first bits specifies a display mode whether the interlace or non-interlace mode, as shown in FIG. 9.

(b) An "EX" at the second bit specifies whether an external synchronization is carried out. When "1" is set at the second bit, free-operation is performed until an external synchronizing signal of proper frequency is detected, and then the free-operation is locked. On the other hand, when "0" is set at the second bit, the external synchronizing operation is generally reset. However, in some cases, the external synchronizing operation may be reset when the external synchronizing signal is greatly disturbed.

(c) A "DCT7" at the third bit specifies whether an image is displayed by 320 dots in the horizontal direction. That is, when "1" is set at the third bit, the 320 dot horizontal display is carried out. In this mode, the dot clock of the VDP unit only attains 7 MHz frequency, so that the cellophane function becomes disabled.

(d) "Blanking bits" at the 8th to 14th bits specify whether the pictures BG, SP, BMO, BM1, BM2, BM3 and RAIN are displayed, respectively. The instruction is available from the following horizontal period.

| | | | |
|---|---|---|---|
| R00 | bit 8 | 0: BG not displayed | 1: BG displayed |
| R00 | bit 9 | 0: SP not displayed | 1: SP displayed |
| R00 | bit 10 | 0: BMG0 not displayed | 1: BMG0 displayed |
| R00 | bit 11 | 0: BMG1 not displayed | 1: BMG1 displayed |
| R00 | bit 12 | 0: BMG2 not displayed | 1: BMG2 displayed |
| R00 | bit 13 | 0: BMG3 not displayed | 1: BMG3 displayed |
| R00 | bit 14 | 0: IDCT/RT image not displayed<br>1: IDCT/RT image displayed | |

If all the "blanking" bits are set at "0", that is, are reset, a black color is supplied as a YUV output (Y=00h, U=80h and V=80h).

Next, the operation of the address and status register is now explained.

Step 1: —CET (chip enable) and Al terminals are set at "L" whereby the address register (AR) is accessed. Then, a register number of a register to be accessed next is written in the address register.

Step 2: Then, the A1 terminal is changed to "H" while the —CET terminal keeps "L" whereby the register written in the address register is selected. Then, predetermined data are written into or read from the selected register.

In these steps, the content of the address register is maintained at the current value until the address register is rewritten. Therefore, the first step may be omitted when the same register is again accessed.

When the address register is read, the register is changed to the status register. The status register holds information such as the raster count value and interlace state.

The data bus to be used is selected between 8 and 16 bit types by an EX8/–16 terminal. While the 8 bit type is used, lower and upper bytes of the register are accessed by setting an A0 terminal at "0" and "1", respectively. On the other hand, while the 16 bit type is used, the level at the A0 terminal is ignored, because 16 bits data can be accessed directly.

FIGS. 14 to 21 show the configurations of a color pallet address register, color pallet data write register, color pallet address offset register 1, color pallet address offset register 2, color pallet address offset register 3, color pallet address offset register 4, priority register 1, and priority register 2, respectively.

COLOR PALLET ADDRESS REGISTER (CPA : R01)

Figure 14:
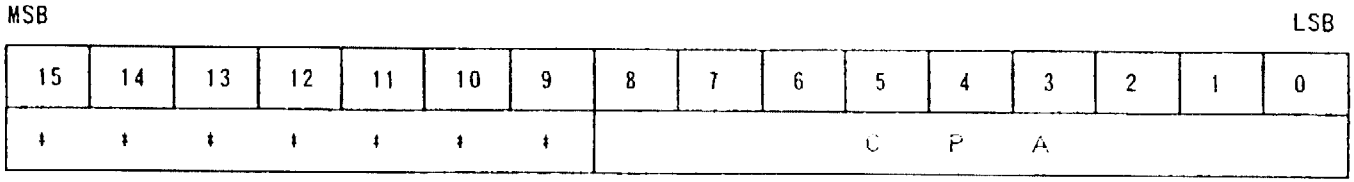

The color pallet address register holds a color pallet address to be used when the color pallet RAM is accessed by the CPU, as shown in FIG. 14. The color pallet data write register and color pallet data read register are accessed in accordance with the color pallet address held in the color pallet address register. The color pallet address register is automatically incremented each time after the color pallet data write and read registers are accessed.

COLOR PALLET DATA WRITE REGISTER (CPW : R02)

Figure 15:
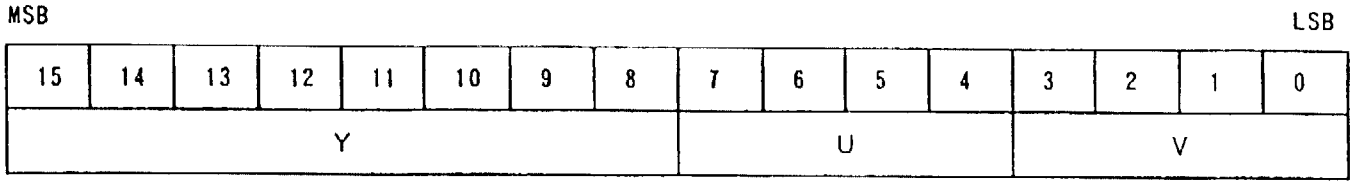

The color pallet data write register holds YUV data to be written at the address CPA in the color pallet RAM by the CPU, as shown in FIG. 15. Each of the Y, U, and V data are indicated by positive whole numbers. Each of the U and V data are treated as 8 bits data by adding "0000" at the end thereof, because the D/A converter treats 8 bits data only. The writing process may carried out continuously by the automatic increment function of the color pallet address register.

When the 8 bit data bus is used, the writing process is carried out in the order of the last half bytes to the first half bytes, because the data are written in the register after the writing process for the first half data is carried out. The increment process of the CPA is also carried out after the first half data are written in the register.

COLOR PALLET DATA READ REGISTER (CPR: R03)

The color pallet data read register holds YUV data to be read from the color pallet RAM by the CPU. The reading process may carried out continuously by the automatic increment function of the color pallet address register.

When the 8 bit data bus is used, the reading process is carried out in the order of the last half bytes to the first half bytes, because the increment process is carried out after the first half data are read out.

COLOR PALLET ADDRESS OFFSET REGISTER

Figure 16:
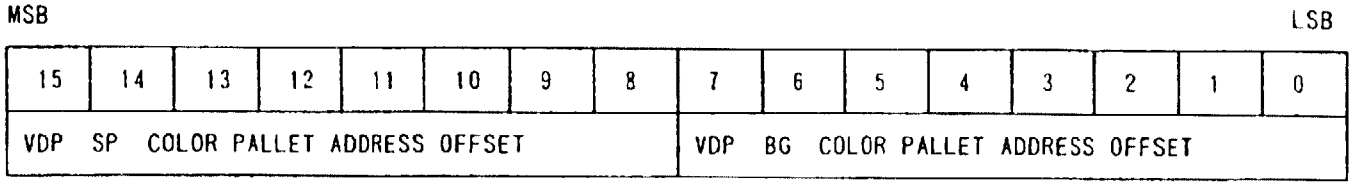

The color pallet address offset register 1, shown in FIG. 16, is used for specifying which color pallet is used first for each of the VDP pictures. Actually, a double value of that held in the register is used as the offset value for the color pallet address. The address offset value is available from the following horizontal display period.

SP color pallet address=SP color pallet data+(SP color pallet offset)×2

BG color pallet address=BG color pallet data+(SP color pallet offset)×2

Figure 17:
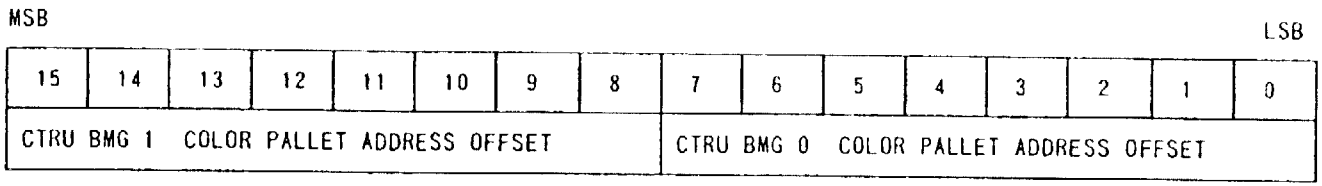

The color pallet address offset register 2, shown in FIG. 17, is used for specifying which color pallet is used first for each of the image pictures supplied from the control unit. In this register, offset values are set for BMO and BM1, respectively.

Actually, a double value of that held in the register is used as the offset value for the color pallet address. The address offset value is effective from the following horizontal display period.

BMGO color pallet address=BMGO color pallet data+(BMGO color pallet offset)×2

BMG1 color pallet address=BMG1 color pallet data+(BMG1 color pallet offset)×2

Figure 18:
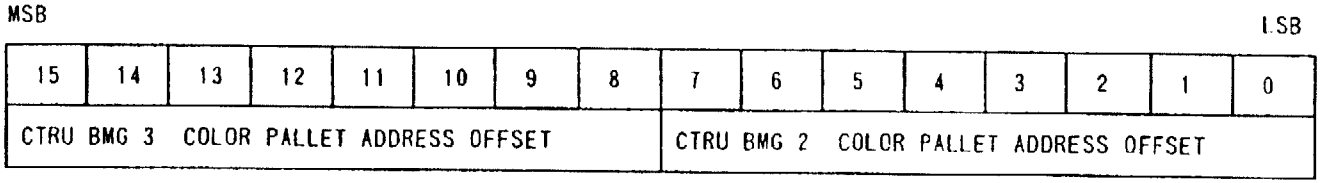

The color pallet address offset register 3, shown in FIG. 18, is also used for specifying which color pallet is used first for each of the image pictures supplied from the control unit. In this register, offset values are set for BM2 and BM3, respectively.

Actually, double values of that held in the register are used as the offset values for the color pallet address. The address offset values are effective from the following horizontal display period.

BMG2 color pallet address=BMG2 color pallet data+(BMG2 color pallet offset)×2

BMG3 color pallet address=BMG3 color pallet data+(BMG3 color pallet offset)×2

Figure 19:
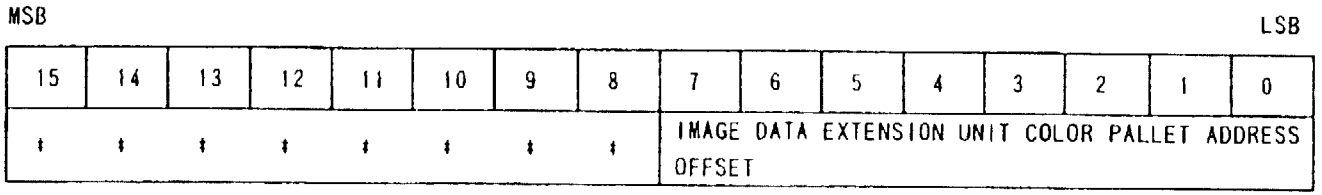

The color pallet address offset register 4, shown in FIG. 19, is used for specifying which color pallet is used first for each run-length picture supplied from the image data extension unit.

Actually, a double value of that held in the register is used as the offset value for the color pallet address. The address offset value is effective from the following horizontal display period.

The color pallet address=run-length color pallet data+(run-length color pallet offset)×2

PRIORITY REGISTER

Figure 20:
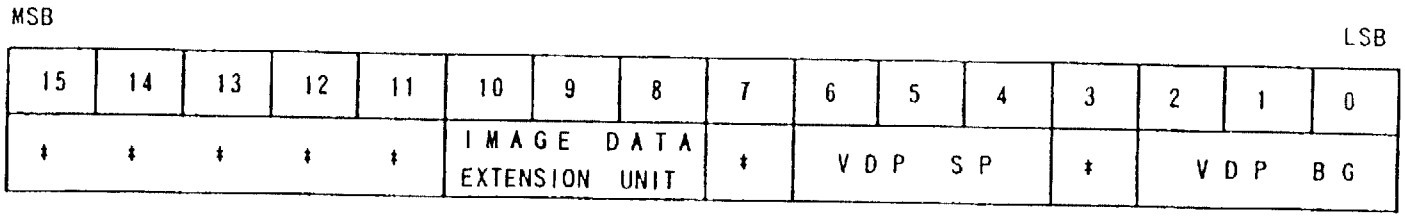
Figure 21:
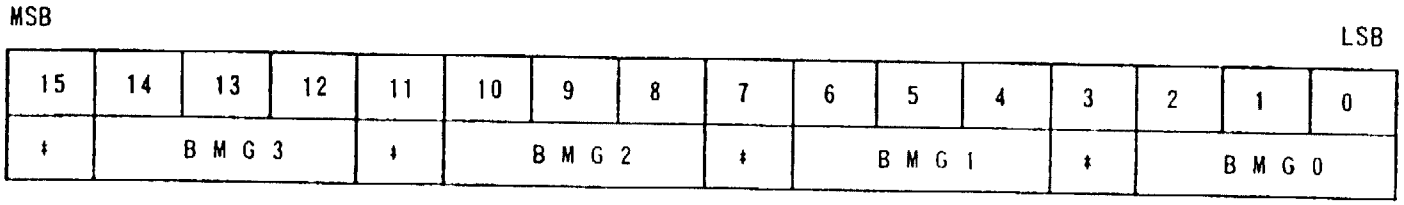

The priority registers 1 and 2, shown in FIGS. 20 and 21, hold data of 3 bits for specifying priority orders of image pictures to be displayed. In these registers, a larger figure has higher priority and a lower figure has lower priority. The same figure is not allowed to be set in the different registers.

Next, how to specify an address in the color pallet will be explained. In the case where the color pallet is commonly used by the BG picture (16 colors) of the VDP unit, the BMGO picture (256 colors), BMG1 picture (16 colors) and BMG2 picture (16 colors) of the control unit, and the run-length picture (128 colors) of the image data extension unit, "C0h","00h", "C8h", "D0h," and "80h" are set in the color pallet address offset register (BG), BMGO color pallet address offset register, BMG1 color pallet address offset register, BMG2 color pallet address offset register, and run-length color pallet address offset register, respectively. In this case, pallet base addresses "180h", "000h", "190h", "1A0h," and "100h" are supplied to the BG picture, BMGO picture, BMG1 picture, BMG2 picture, and run-length picture, respectively.

As described before, according to the preferred embodiment, each picture has own offset address, so that the single color pallet may be used effectively.

In the computer system, combination data of three different types, "external block sequence," "external dot sequence" and "internal dot sequence," are used to form the background image.

According to the internal dot sequence, a natural picture supplied from an image scanner or the like is directly displayed by a bit-map technique. Therefore, the BAT is not necessary for that type data.

On the other hand, the other two types data are image data managed by the BAT and CG in the VRAM. In the external block sequence process, the CG indicates a character pattern in the same manner as the conventional system. In the external dot sequence process, the CG indicates a dot.

Figure 22:
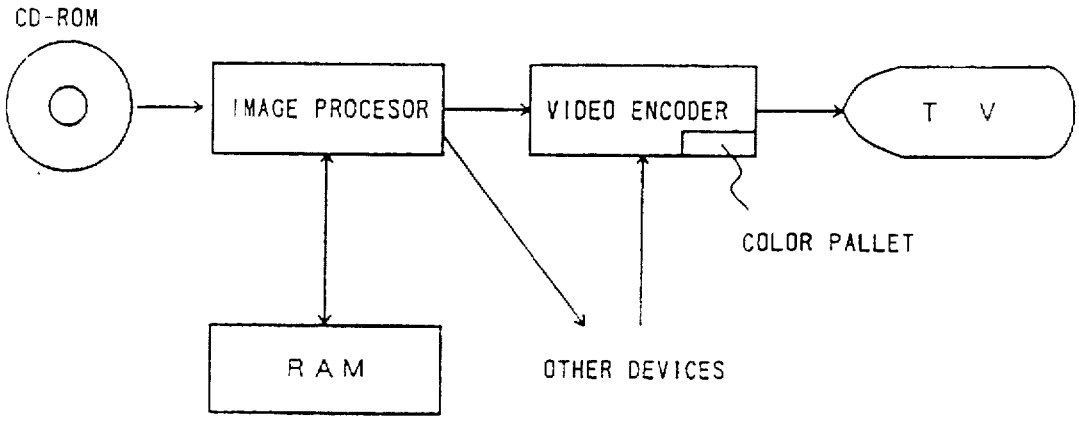
FIG. 22 is a diagram showing a process for background data in accordance with the preferred embodiment.

The image data generated from the three types data are supplied through the video encoder to the TV display, as shown in FIG. 22.

The three types of sequence processes are now explained.

(1) EXTERNAL BLOCK SEQUENCE PROCESS

Figure 1:
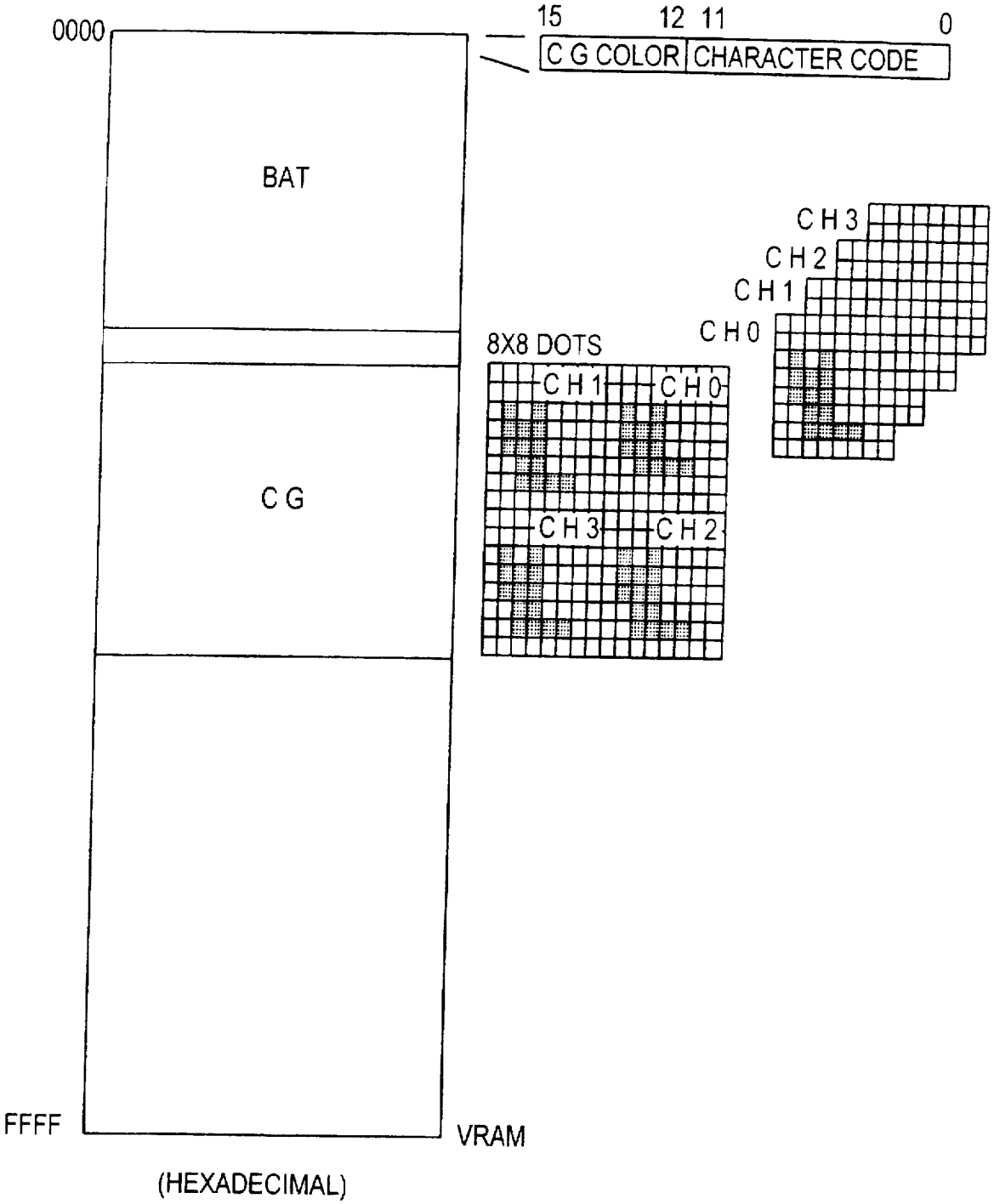
FIG. 1 PRIOR ART
FIG. 1 is a diagram showing a configuration of a VRAM according to a conventional computer system.
Figure 2:
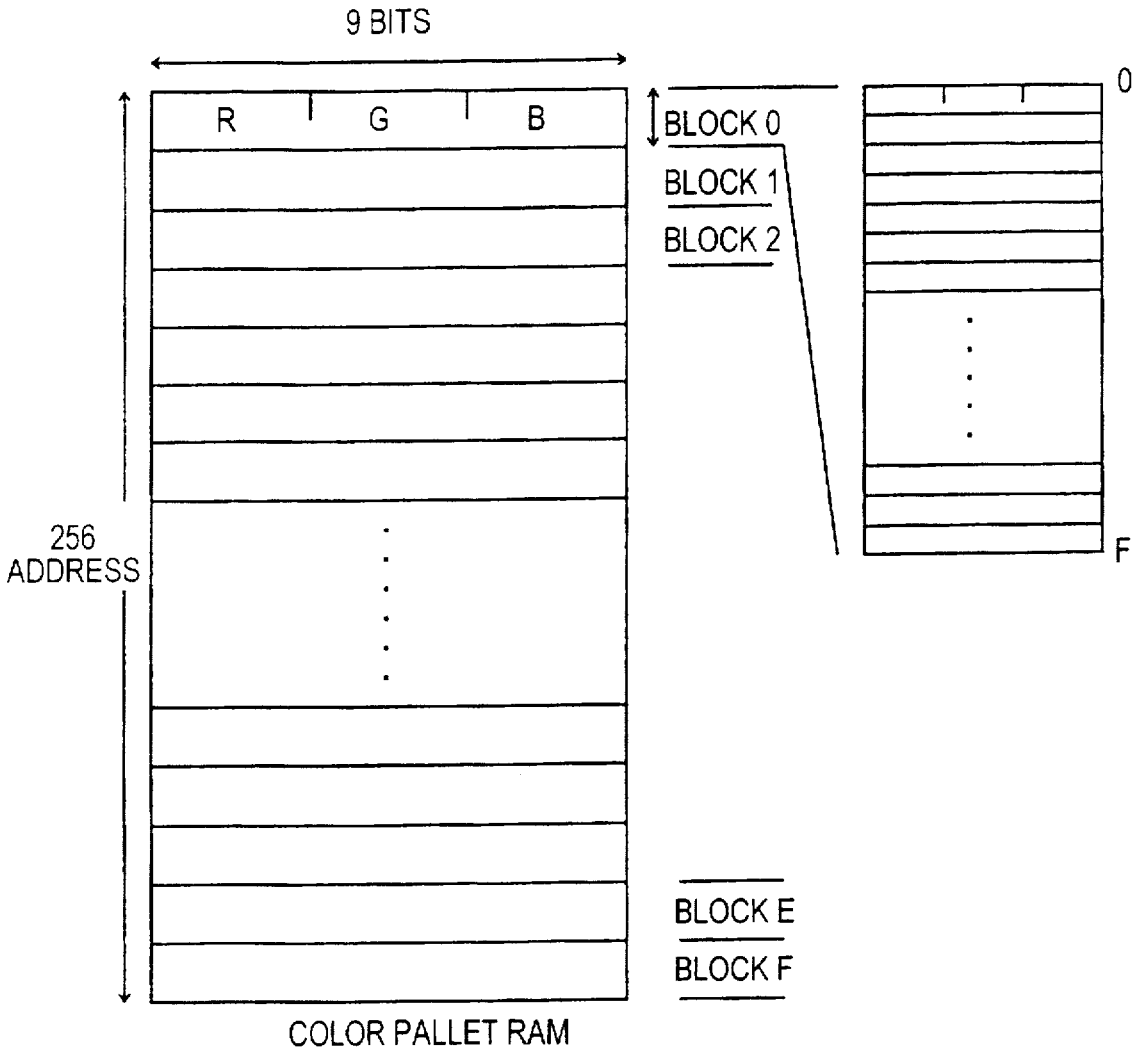
FIG. 2 PRIOR ART
FIG. 2 is a diagram showing a configuration of a color pallet RAM in accordance with the conventional computer system.
Figure 3:
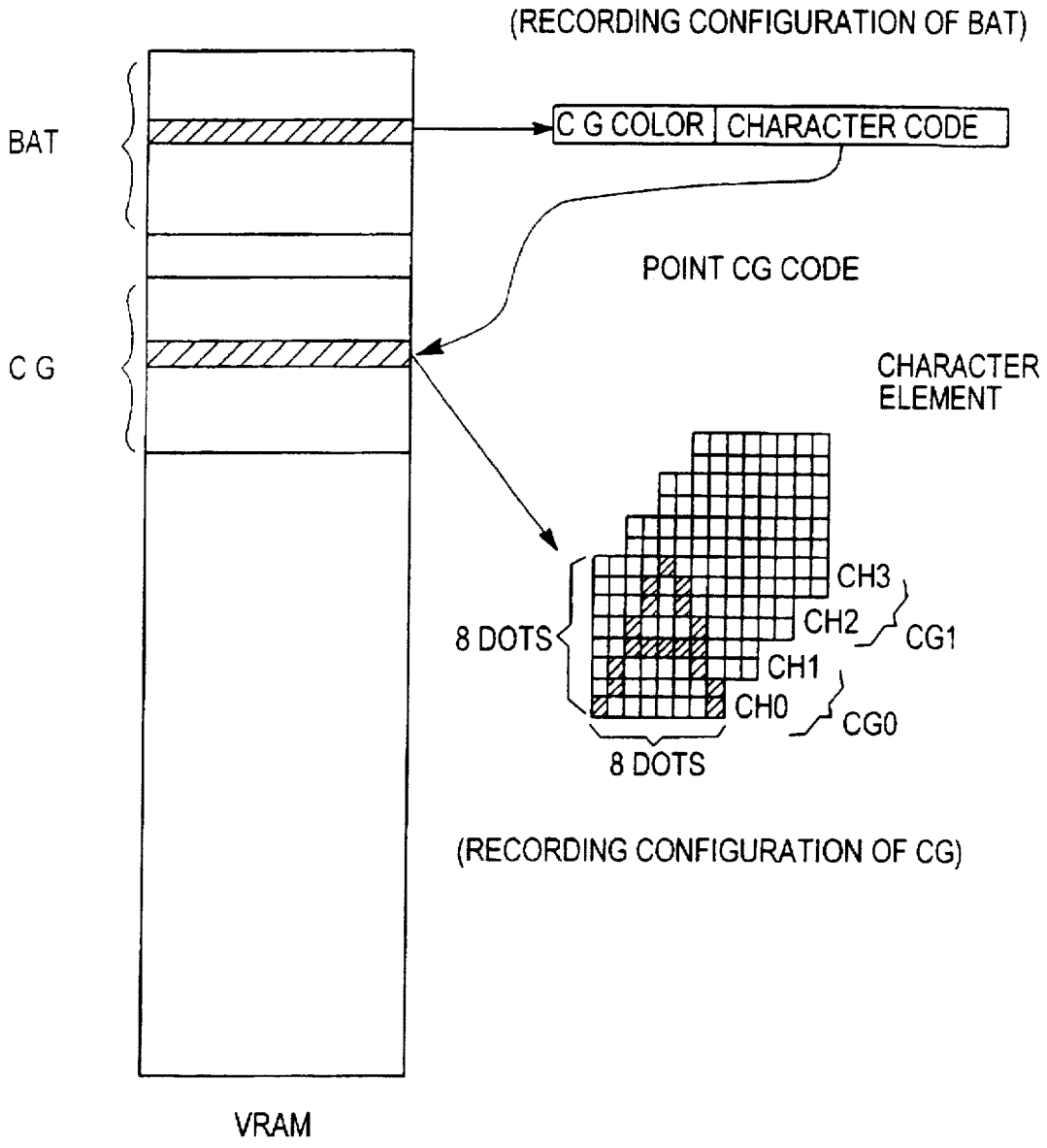
FIG. 3 PRIOR ART
FIG. 3 is a diagram showing the configuration of a VRAM in accordance with the conventional computer system.
Figure 4:
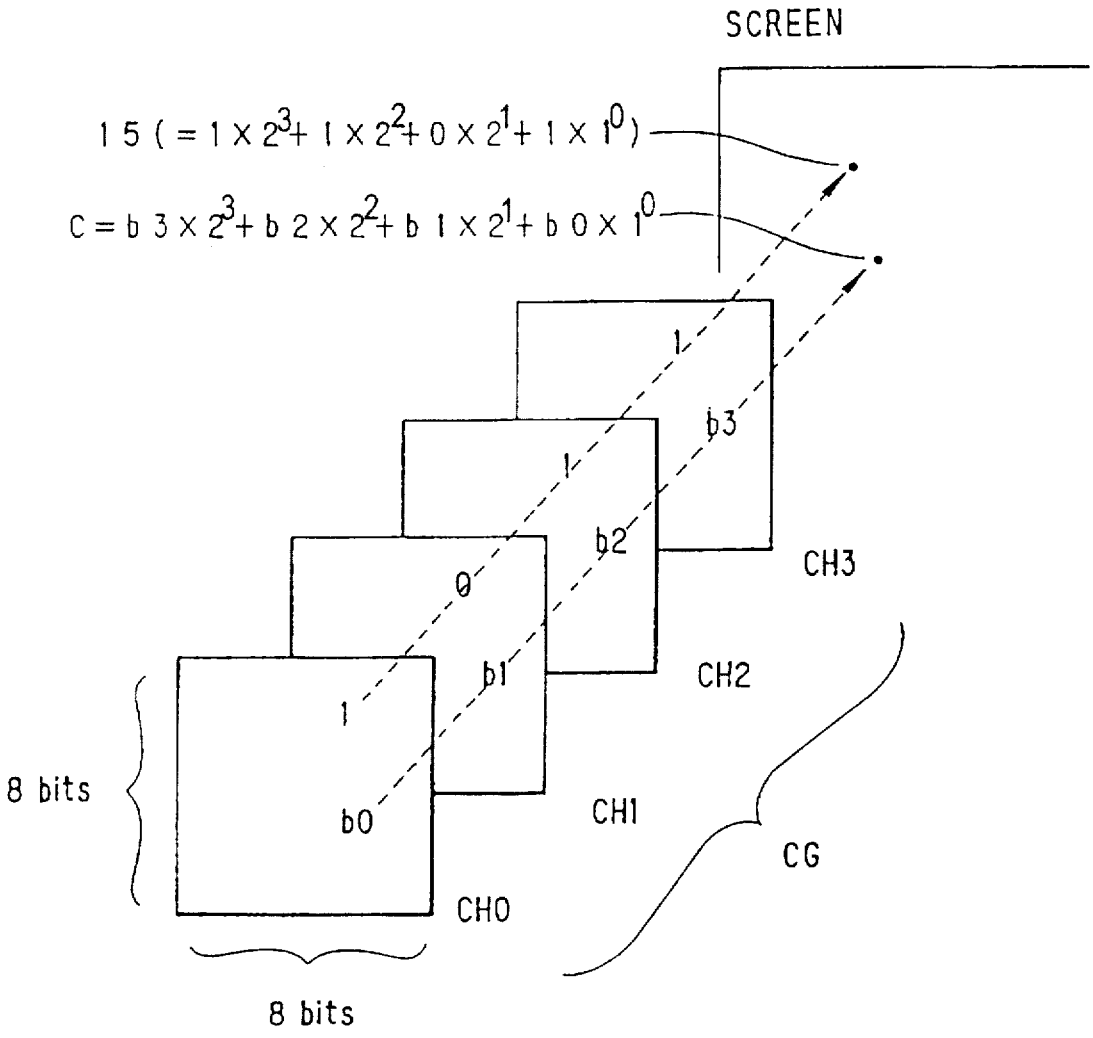
FIG. 4 PRIOR ART
FIG. 4 is a diagram showing operation of the conventional computer system.
Figure 5:
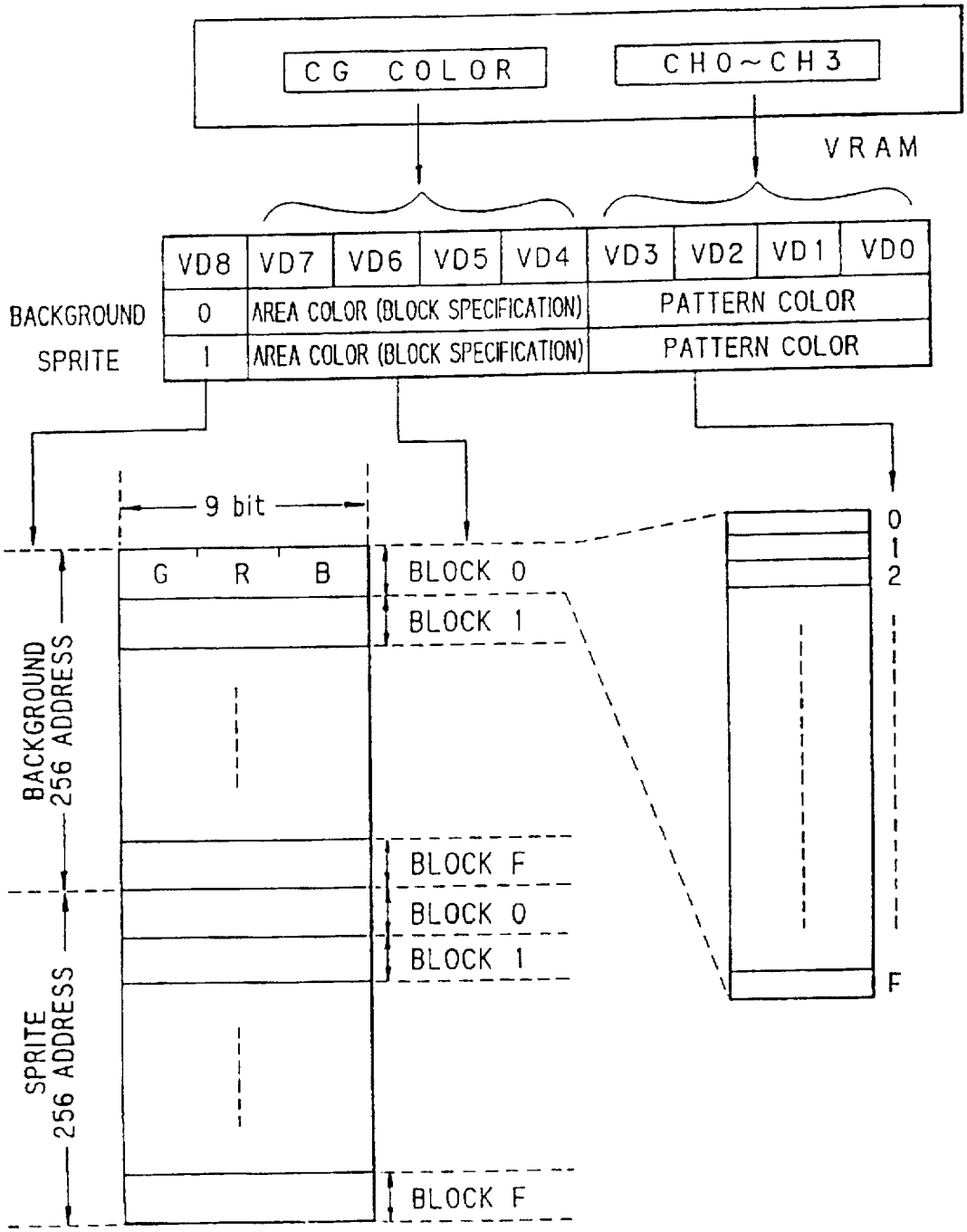
FIG. 5 PRIOR ART
FIG. 5 is a diagram showing the configuration of a CG shown in FIG. 3.
Figure 23:
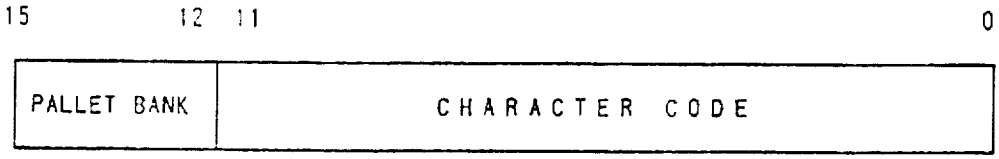
FIG. 23 is a diagram showing the configuration of the BAT.

FIG. 23 shows a BAT (background attribute table) which is composed of a pallet bank and character code. The pallet bank stores data corresponding to a bank stored in the video encoder, the pallet bank corresponding to "CG COLOR" shown in FIG. 3. The color pallet includes color groups each composed of 16 colors, the color groups being selected in accordance with data stored in the pallet bank.

The pallet bank is effective in a 4 color mode and 16 color mode only, and other color modes are neglected. The character code is used for specifying a CG (character generator), whereby a CG address is defined by the character code and data in a CG address register. Each character pattern is defined by 64 dots of "8×8" by the CG. A bits number "n" required for representing each dot is given by the following equation, where colors of the number "m" are used simultaneously to display the dot. The numbers of dots that must be used to define a color for one dot are different depending on the color modes.

$n=\mathrm{Log}_2\ m$

When "m" is 4, 16, 256, 64 k or 16M, "n" becomes 2, 4, 8, 16 and 24. A RAM is arranged to be addressed by 16 bits (=1 word), so that 2 dots are indicated by 32 bits when "m=16M".

Figure 24:
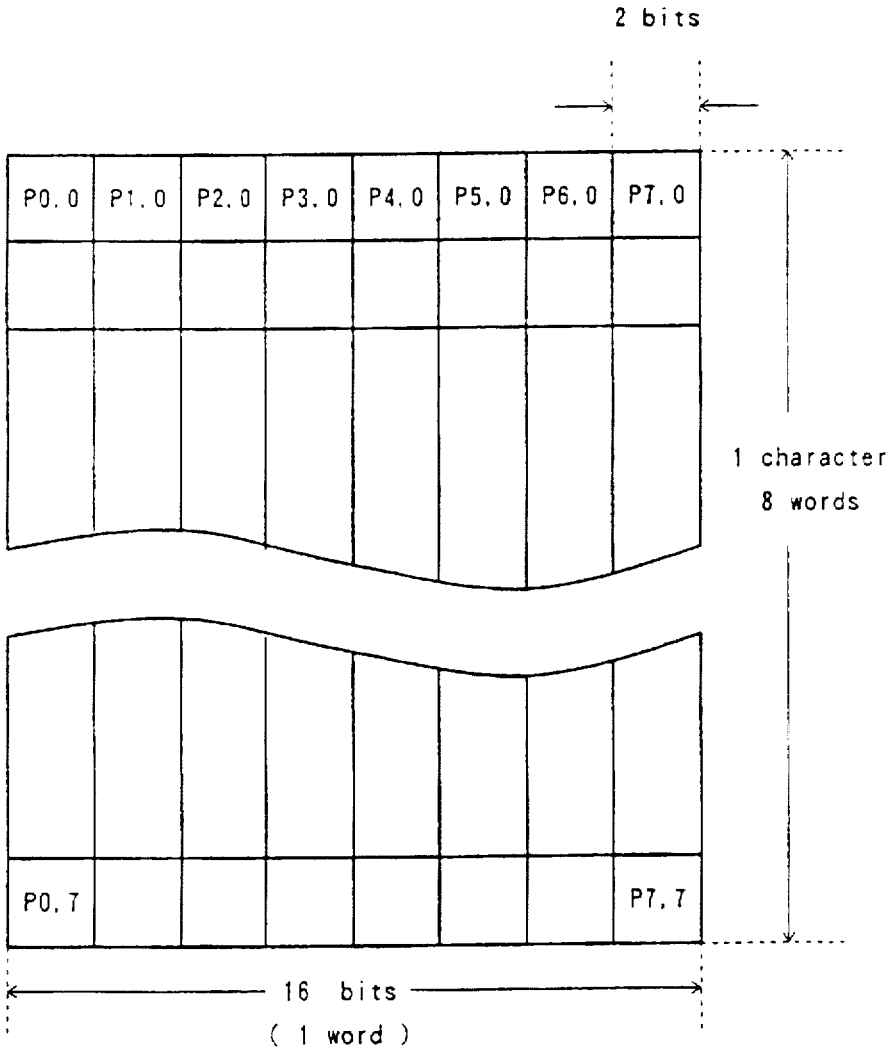
FIGS. 24 to 28 are diagrams showing the RAM bit-structures in a 4, 16, 256, 64K and 64M color modes, respectively, in an external block sequence process according to the preferred embodiment.
Figure 25:
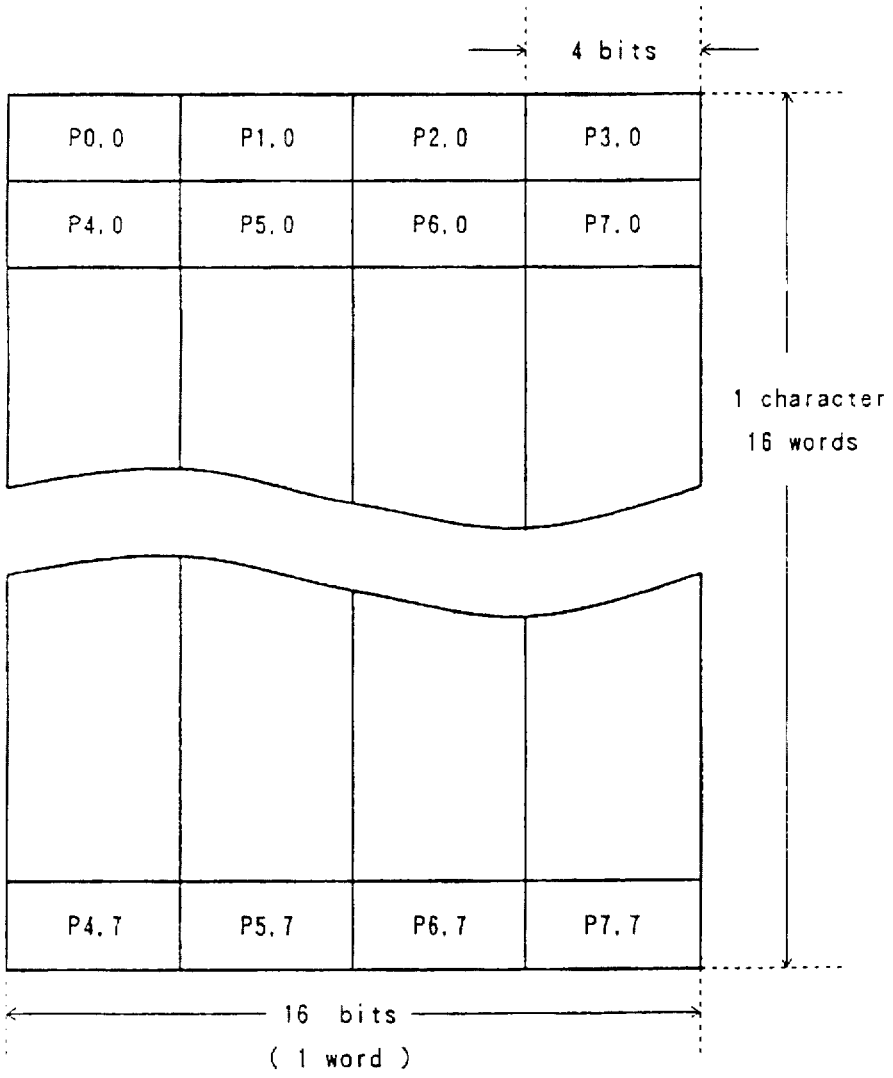
Figure 26:
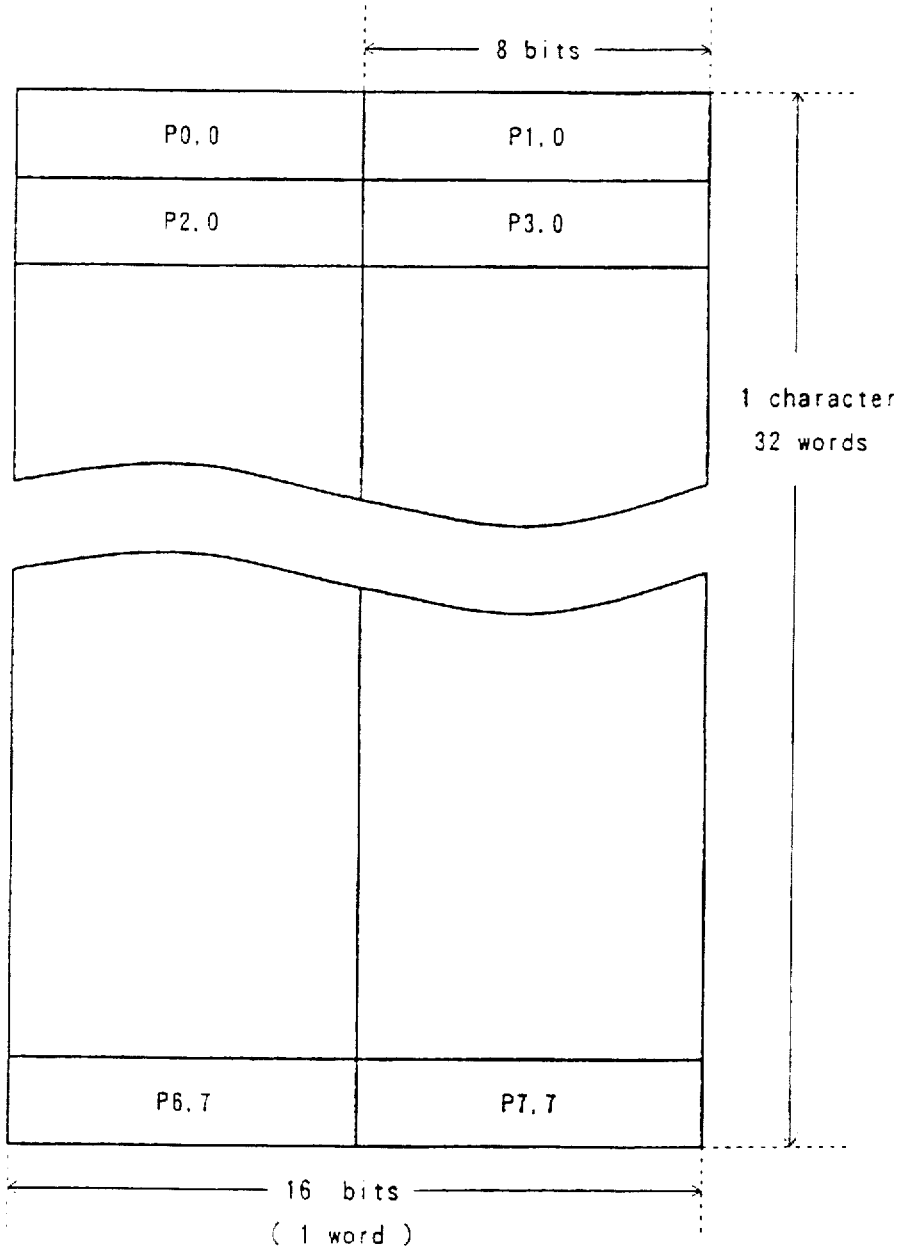

FIGS. 24, 25 and 26 show the bit structures of the RAM in 4, 16 and 256 color modes, respectively. In accordance with the RAM structures, positions on the color pallet, which are used for specifying a color to be displayed, are defined. The color pallet has a capacity of 256 colors, so that the color pallet may be pointed directly in the 256 color mode. In other words, the pallet bank does not need in the 256 color mode.

Figure 27:
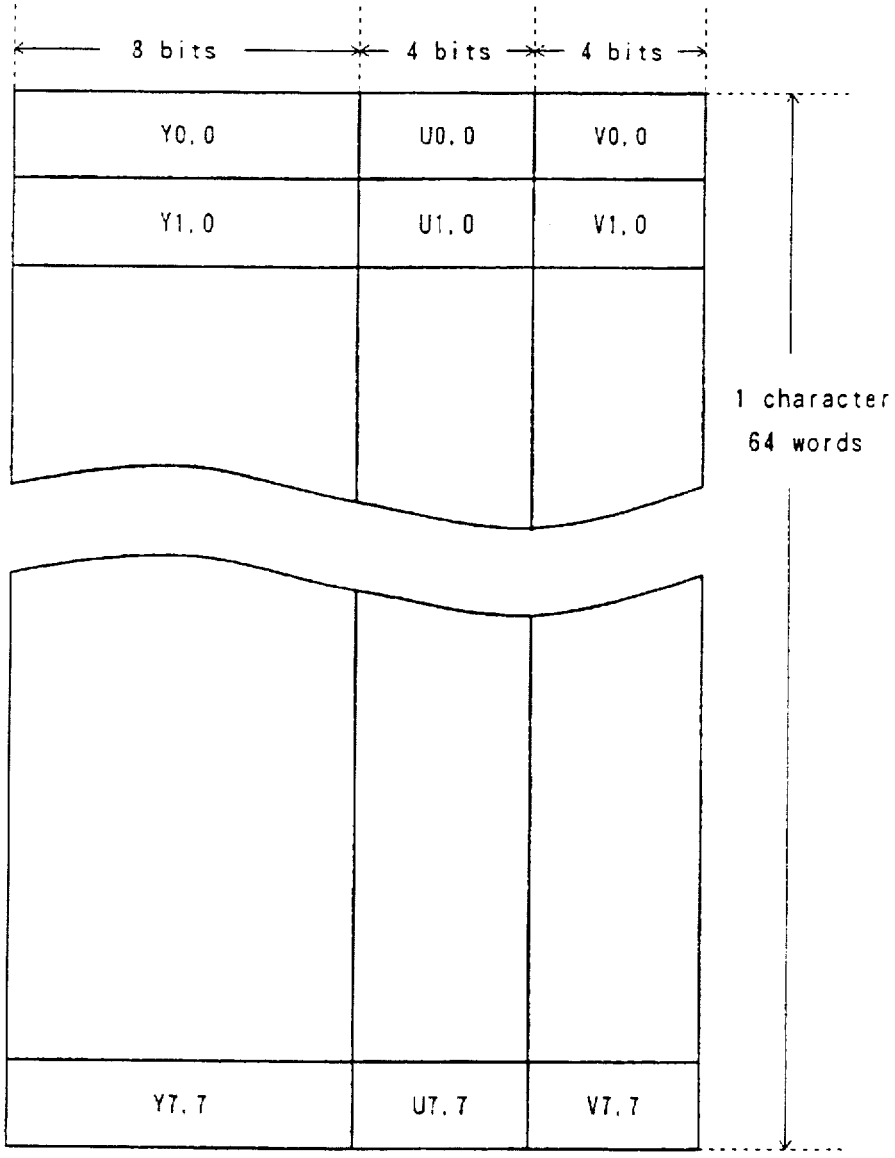
Figure 28:
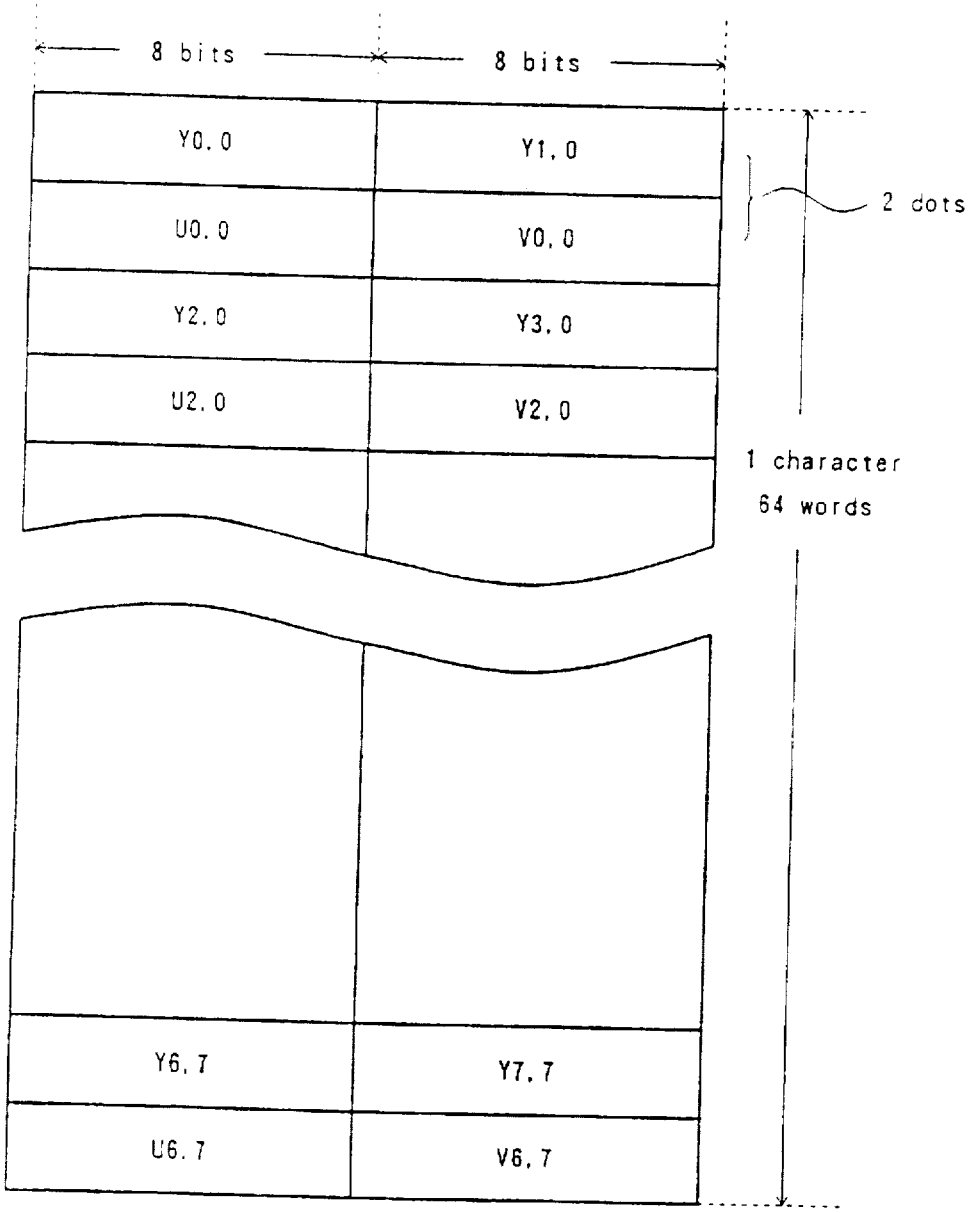

FIGS. 27 and 28 show the structures of the RAM in 64K and 16M color modes, respectively. In these color modes, color data are specified directly without using the color pallet. In the 64K color mode, one dot color data are specified by YUV (Y of 8 bits, U of 4 bits and V of 4 bits). On the other hand, in the 16M color mode, two dots color data are specified by YYUV (Y of 8 bits, Y of 8 bits, U of 8 bits and V of 8 bits). The first "Y" represents the brightness of a first dot, the second "Y" represents the brightness of a second dot and "U" and "V" represent the common color shift of the first and second dots.

In a natural picture, successive dots are not very different in color from each other, so that the next dots may be separated in color by adjusting the brightness thereof. Thus, a character pattern may be defined by small data. As a result, the character pattern may be defined by 64 word data which is the same as that in 64k color mode. According to the external dot sequence system, the conventional BG image data may be used as they are.

(2) EXTERNAL DOT SEQUENCE PROCESS

The external dot sequence process is basically equal to the external block sequence process; however, image data are processed dot-by-dot, not block-by-block (character-by-character). Therefore, only one line in the tables shown in FIGS. 6 and 7 is used to define the CG. In 16M color mode, two lines are used to define two dots. The external dot sequence process is especially good for using the memory when a color is continuously changed with time or with position on an image. According to the external block sequence process, the memory can be used effectively when image data have the same color.

Figure 29:
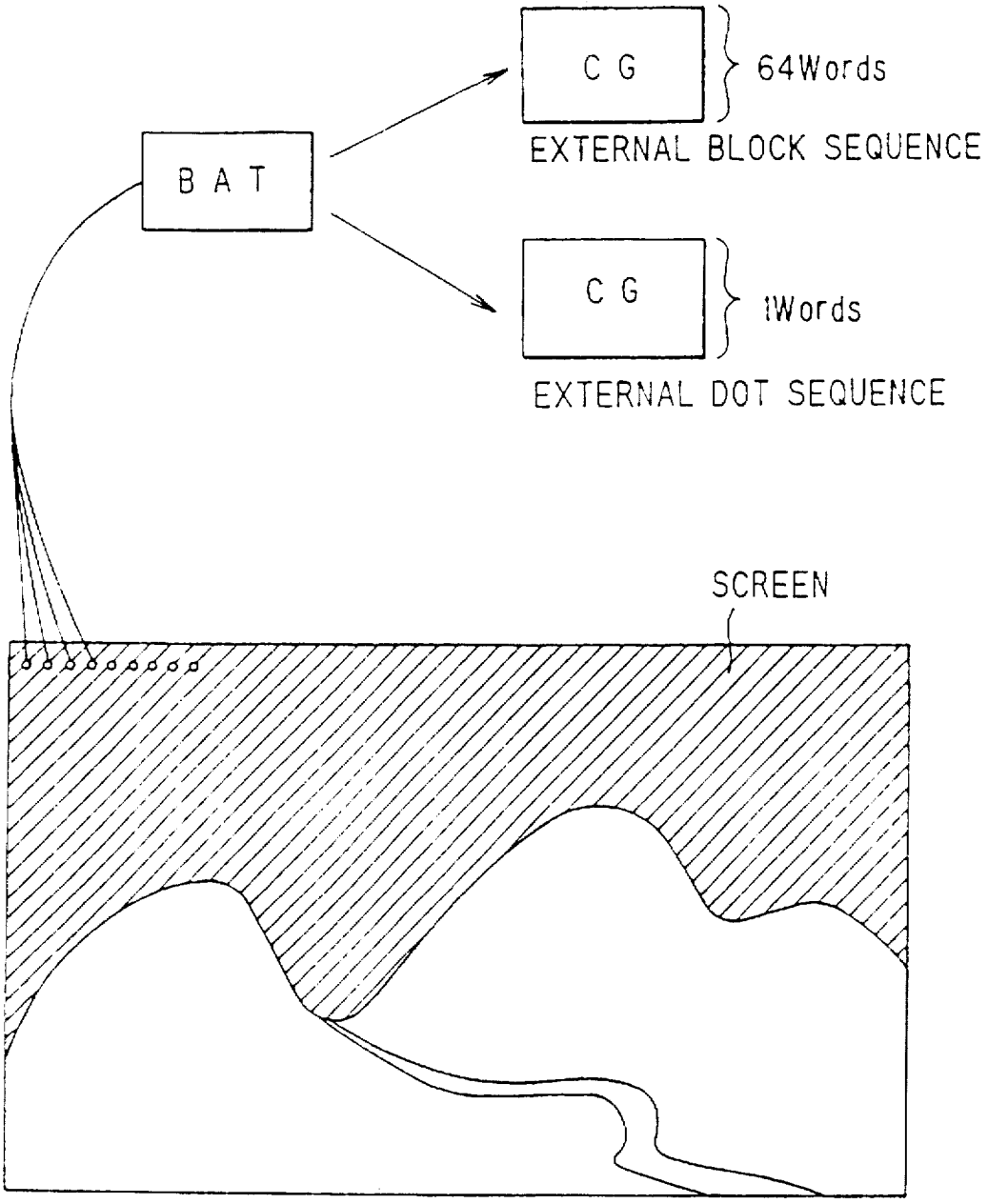
FIG. 29 is a diagram showing a relation between the BAT and CG in the 64K color mode.

The reason that the external dot sequence data are necessary is now explained in conjunction with FIG. 29. On this picture, a single color is used for showing the sky, and the color varies with time. The 64K color mode is used to display the color of sky more naturally. Either of the external block sequence and external dot sequence types is available in this case. When the external block sequence type data are used, 64 words (=1024 bytes) data must be stored in the CG, because the background is defined pattern-by-pattern of 8×8 dots by the CG. On the other hand, when the external dot sequence type data are used, only one word (16 bytes) data must be stored in the CG, because the background is defined dot-by-dot.

In the external dot sequence process, if the color of the sky varies in the order of blue-white, light-red, red, dark-red, red-purple, dark-blue, and black, seven CGs are prepared and the character code is changed in that order. In this case, the external block sequence type data and external dot sequence type data need the CG sizes of 64×(CG number) words and 2×(CG number) words, respectively. If the CG number is 8, the former becomes 512 words and the later becomes 16 words. Therefore, the external dot sequence type data are useful in such a case.

It can be considered that the CG performs instead of the color pallet in the external dot sequence process, because one CG specifies one color directly. Therefore, many colors may be used for displaying a picture by using a small capacity of the memory.

(3) INTERNAL DOT SEQUENCE PROCESS

In the internal dot sequence process, colors are defined for each dot in the same manner as the external dot sequence process. In the 16M color mode, two dot data may be defined by two words of YYUV. Therefore, 16M colors can be defined by the CG having a small capacity, and repeatability of the image is not seriously affected by the process. The internal dot sequence process is especially useful for the case where a natural picture is displayed and each dot of the image has independent color data. As mentioned above, according to the internal dot sequence process, a picture supplied from an external visual unit may be treated the same as the others, so that the data process becomes simple.

As described above, according to the present invention, a system of the BG image data is changed in accordance with the number of colors to be used, so that the computer system may manages a wide range color 4 to 16M by using a small memory region.

We claim:

1. An image processing apparatus comprising;

means for storing four types of image pictures which are sprite pictures, background pictures, natural background pictures, and moving pictures, each type of said image pictures having its own offset address;

a color pallet table for storing preselected colors;

means for storing YUV data composed of brightness data and color difference data;

means for calculating a color pallet address for each type of said image pictures in accordance with said offset address thereof and defining colors of said image pictures based on said color pallet table and the calculated address when the number of colors of said image pictures is less than the number of said preselected colors;

means for defining colors of said image pictures by said YUV data when the number of colors of said image pictures is greater than the number of said preselected colors; and displaying means for displaying said image pictures with the defined colors.

2. The image processing apparatus according to claim 1, wherein;

said color pallet addresses are calculated by as follows: Color Pallet Address=Color Pallet Data+2×Offset Address.

* * * * *